US005533216A

United States Patent [19]

Thier

[11] Patent Number: 5,533,216

[45] Date of Patent: Jul. 9, 1996

[54] MODULAR SLEEPING BAG

[76] Inventor: Howard F. Thier, Sherwood Ct., P.O. Box 399, Alpine, N.J. 07602

[21] Appl. No.: 294,549

[22] Filed: Aug. 23, 1994

[51] Int. Cl.[6] ..... A47C 29/00

[52] U.S. Cl. ..... 5/413 R

[58] Field of Search ..... 5/413; 2/69.5

[56] References Cited

U.S. PATENT DOCUMENTS

| | | | |
|---|---|---|---|
| 983,223 | 1/1911 | Fitch | 5/413 |
| 2,064,458 | 12/1936 | Bulpit et al. | 2/69.5 |
| 2,321,966 | 6/1943 | Andersson | 5/416 |
| 2,379,416 | 7/1945 | Clark | 5/413 |
| 3,175,231 | 3/1965 | Magario et al. | 5/413 |
| 3,178,734 | 4/1965 | Carrez | 5/413 |
| 3,564,629 | 2/1971 | Rogius | 5/413 |
| 3,584,323 | 6/1971 | Worley | 5/413 |
| 3,831,206 | 8/1974 | Geary | 5/413 |
| 3,988,791 | 11/1976 | Simon | 5/413 |
| 4,513,461 | 4/1985 | Tardivel | 5/413 |
| 4,888,828 | 12/1989 | Tatsuno | 5/413 |
| 5,005,235 | 4/1991 | Huang | 5/413 |
| 5,072,465 | 12/1991 | Lyons, Jr. | 5/413 |
| 5,072,466 | 12/1991 | Bond et al. | 5/413 |
| 5,343,578 | 9/1994 | Kettenhofen | 5/413 |

*Primary Examiner*—Michael J. Milano

*Attorney, Agent, or Firm*—Cohen, Pontani, Lieberman, Pavane

[57] ABSTRACT

A sleeping bag having a plurality of superposed bags, one within the other, the number of superposed bags depending on the degree of thermal protection desired. Besides having an opening to expose a user's face, each bag has an open side, closable by a slide fastener, to facilitate entering or exiting the sleeping bag. Disposed along and proximate both sides of the slide fastener of each bag are two rows of non-slide-type fasteners having top and bottom engagement surfaces secured to the outer and inner surfaces of each bag. The non-slide-type fasteners can be used either for selectively attaching an inner bag to an outer bag or for closing the open side in the event that the corresponding slide-type fastener fails to operate. A weather-resistant shell may also be selectively attached to the outer bag for additional protection.

7 Claims, 5 Drawing Sheets

MODULAR SLEEPING BAG

BACKGROUND OF THE INVENTION

1. Field of the Invention

This invention relates generally to sleeping bags, and more particularly, a modular sleeping bag featuring a bag-in-a-bag construction for bivouac use such as during camping, hiking, backpacking or the like.

2. Background of the Invention

Sleeping bags are critically important to those adventurous souls who choose to or have been chosen to spend nights in untamed parts of the world. Whether one is a novice backpacker, or an experienced outdoors-person, a principal objective while camping is to keep warm during cold nights, especially during unexpected periods of extreme cold or freezing rain.

It is well known that overnight temperatures vary widely depending upon the particular season, geographic location, terrain, weather condition, and so forth. A sleeping bag capable of providing different degrees of thermal protection in response to these variations would therefore be particularly advantageous. Moreover, because of the varied degrees of metabolic rate of different users, adjustment of the thermal protection levels of a sleeping bag would also be desirable even when the users are faced with the same ambient temperature.

Conventional sleeping bags offer passive thermal protection by providing a layer of thermal insulating materials. Although varied degrees of thermal protection might be achieved by varying the thermal insulation quality and the thickness of the insulating layer, such sleeping bags generally include only a single insulating layer of constant thickness and uniform thermal insulating property. Consequently, a user may find a sleeping bag too warm or too cold as the ambient temperature changes from one night to the next. A user may thus need to bring along a number of sleeping bags for a particular trip. Such a solution is highly undesirable in terms of a user's limited resources, cargo space or handling ability.

Various attempts have been made to overcome the problem of constructing a sleeping bag that provides thermal protection over a wide range of temperature. For example, U.S. Pat. No. 3,584,323 to Worley teaches a construction of a sleeping bag that is convertible into a single sleeping bag, or two sleeping bags. The disclosed construction requires the attachment of two smaller blankets to a large blanket thus forming two "pockets" or sleeping bags on the large blanket. A user may choose to fold the large blanket along its centerline to form one sleeping bag having double layers of blankets. Alternatively, the user may form a pair of sleeping bags by unfolding and laying flat the large blanket, i.e., the outer layer of the single sleeping bag. Slide-type fasteners such, for example, as zippers are disclosed for fastening the edges of the large blanket to form a sleeping bag. Therefore, with this sleeping bag construction, a user may have either a single or double layer of thermal insulation.

U.S. Pat. No. 4,888,828 to Tatsuno discloses a sleeping bag having only a "head opening" for entering and exiting the bag, and a plurality of elastic bands spaced apart and along the length of the bag. The elastic bands constrict the cross-sectional areas of a bag and thus restrain the relative movement of the bag(s) and the user. This patent teaches that an inner bag can be placed within an outer bag. The inner bag is held in place by friction generated by the elastic bands. Therefore, a user may afford varied temperature protection by varying the layer of inner bags.

U.S. Pat. No. 5,005,235 to Huang discloses the construction of a two-person modular sleeping bag. The two-person sleeping bag is formed by unfolding and laying flat two one-person sleeping bags, then superimposing one unfolded bag over another, and fastening the top unfolded bag to the bottom unfolded bag by means of zippers. The Huang patent also teaches the insertion or removal of thermal insulating pads into or out of a compartment formed along a side of a sleeping bag so as to accommodate usages in fall or winter.

A disadvantage of the aforementioned sleeping bags is that they fail to provide variable thermal protection and a fail-safe feature for closing an open side of a sleeping bag.

SUMMARY OF THE INVENTION

The present invention provides a sleeping bag comprising a plurality of superposed bags. Each bag has a slide-type fastener (e.g., a zipper) disposed along adjacent edges of an open side for closing thereof, although other linear fasteners may be employed, such, for example, as hook-and-loop, e.g. Velcro®, fasteners. Moreover, positioned along both sides of the slide-type fastener is a set of non-slide-type fasteners, such as hook-and-loop fasteners or snap fasteners or the like having top and bottom engagement surfaces which are selectively attachable to engagement surfaces of corresponding non-slide-type fasteners. Thus a series of inner bags, preferably having non-slide-type fasteners may be selectively secured to each other by engaging corresponding non-slide-type fasteners on each bag in a stacked manner. The non-slide-type fasteners may be secured substantially adjacent to the slide-type fastener so as to provide a fail-safe feature for closing the open side of a bag in the event the slide-type fastener fails to operate. In such a case, the non-slide-type fasteners may be employed to close an open side by overlapping adjacent edges of the open side and engaging corresponding non-slide-type fasteners. The present invention also provides an outer shell for selective attachment to the outermost bag so as to increase protection from the weather.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings wherein like reference characters denote similar elements throughout the several views.

DETAILED DESCRIPTION OF THE PRESENTLY PREFERRED EMBODIMENTS

Figure 1:
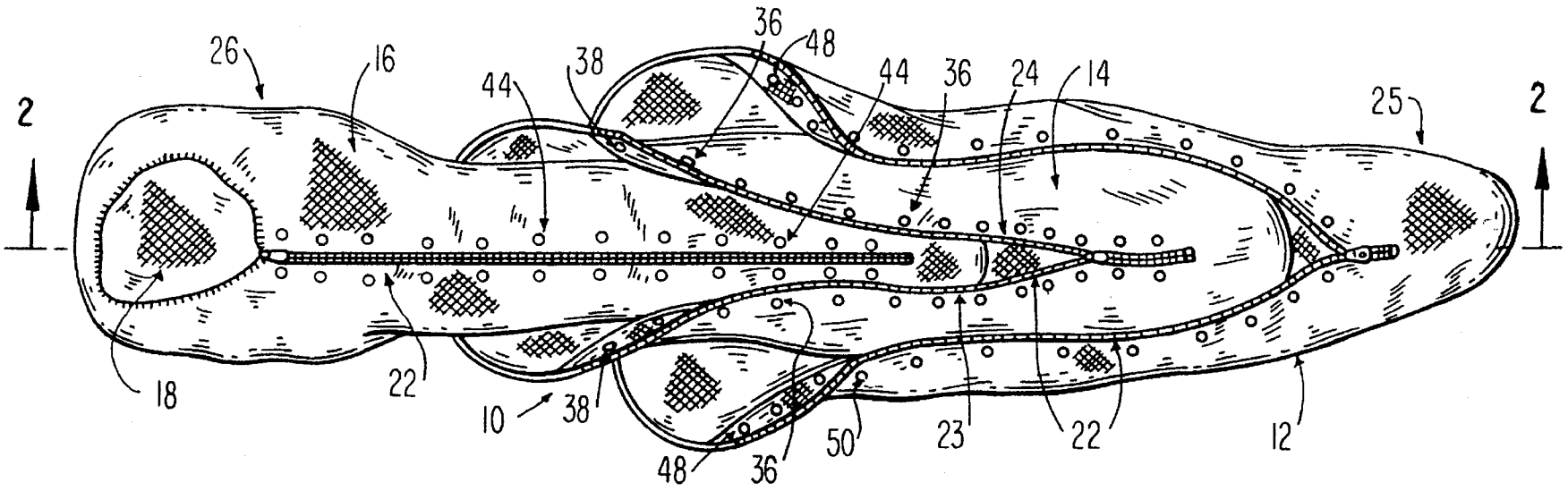
FIG. 1 is a top view of a bag-in-a-bag sleeping bag embodying the present invention, the sleeping bag being in a partially disassembled state.
Figure 2:
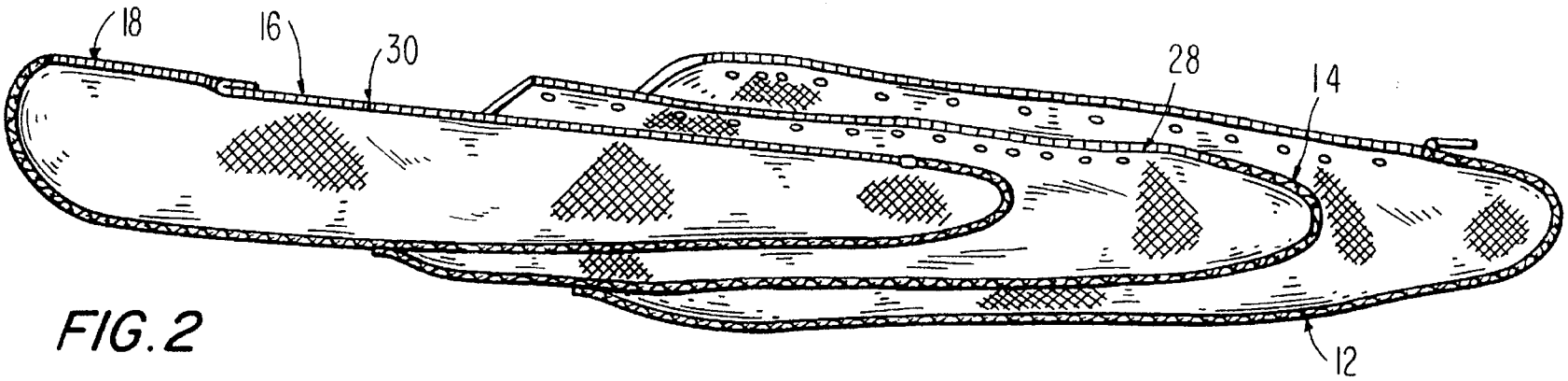
FIG. 2 is a cross-sectional view of the sleeping bag of FIG. 1 taken along Line 2—2 in FIG. 1.

A sleeping bag device 10 constructed in accordance with an illustrative embodiment of the present invention is depicted principally in FIGS. 1 to 2. With initial reference to FIG. 1, sleeping bag 10 has an outer shell 12, an outer bag 14, and an inner bag 16. The inner bag 16 is dimensioned so as to be positionable, as by slidable insertion, within the outer bag 14. Each bag or shell has an adjustable head opening 18 for exposing at least a portion of a user's face. Each bag also has an open side with a slide-type fastener 22 such, for example, as a zipper attached to adjacent edges 23, 24 of the open side for closing thereof. Alternatively, the open sides can be closed by another linear fastening means, such, for example, as a hook-and-loop, e.g. Velcro®, fastener.

The sleeping bag 10 shown in FIG. 1 has a foot portion 25 and a head portion 26, the foot portion 25 preferably being narrower in width than the head portion 26. The outer shell 12 is preferably made from a light-weight material such, for example, as a cloth-nylon laminate, that is resistant to water, wind and wear yet permeable to moisture vapor. The outer and inner walls of both the outer bag 14 and inner bag 16 are preferably made of a light-weight material such, for example, as nylon. Outer shell 12 envelopes the entire outer surface of the outer bag 14 so as to provide weather-resistant protection to the plurality of bags encased therein.

As best seen in FIG. 2, outer bag 14 has a thermal insulating layer 28 and inner bag 16 has a thermal insulating layer 30, each insulating layer being enclosed between its respective inner and outer walls. The thermal insulating layers 28 and 30 may be of different thicknesses or have different thermal insulating properties so that a user may employ a variety of inner bags for varying weather conditions. In a currently preferred embodiment, thermal insulating layer 28 of outer bag 14 comprises a single layer of insulation materials such, for example, as polyester batting quilted to the inner wall thereof; in comparison, thermal insulation layer 30 of inner bag 16 is thicker, and comprises two layers of insulation materials such, for example, as polyester batting—with a first and second layers quilted to the inner and outer walls thereof, respectively. Of course, other types of flexible thermal insulation may be employed without departing from the invention.

Figure 3:
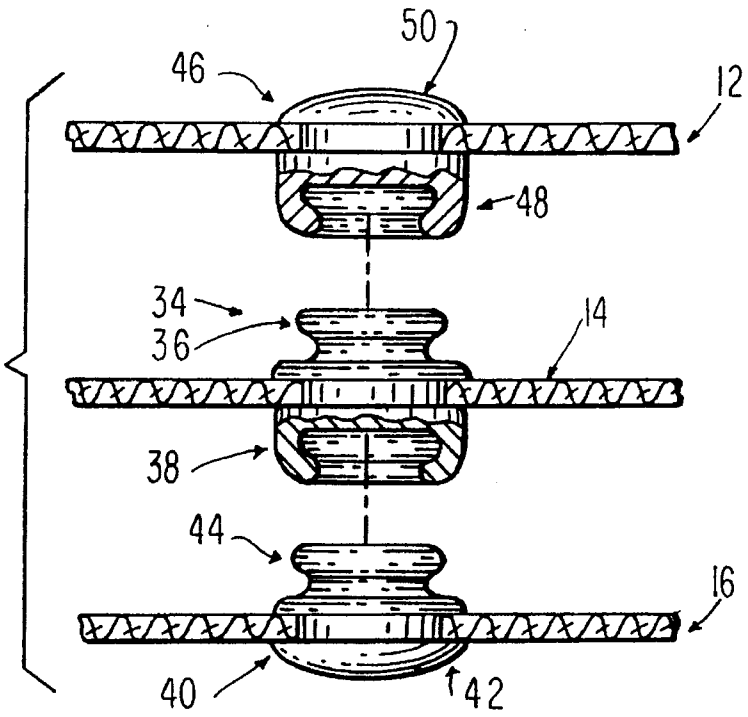
FIG. 3 is a side view of a two-sided snap fastener, one embodiment of non-slide-type fastener, shown in an unconnected condition.

Disposed along both sides of the slide-type fastening means 22 are non-slide-type fastening means having top and bottom engagement surfaces. The top and bottom engagement surfaces are such that the non-slide type fastening means are selectively attachable to each other in a stacked manner as illustrated by the embodiment shown in FIG. 3. These non-slide-type fastening means serve to advantageously fix the spatial relationships of the outer bag 14 and inner bag 16. The embodiment of FIG. 3 demonstrates a non-slide-type fastening means whose engagement surfaces are engageable by means of male-female geometry. More particularly, the depicted non-slide-type fastening means is a two-sided snap fastener 34 with oppositely disposed male and female portions 36 and 38, respectively. The two-sided fasteners 34 may be engaged by snapping together their corresponding male portion 36 and female portion 38. In combination with the two-sided snap fasteners 34, there may be used one-sided male fasteners 40, having a cap portion 42 and a male portion 44, and one-sided female fasteners 46,, having a female portion 48 and a cap portion 50. FIG. 3 shows one preferred arrangement of one-sided and two-sided snap-type fasteners. Of course, another arrangement is just as effective such, for example, as in the case where the genders of the fasteners are correspondingly reversed.

Figure 3A:
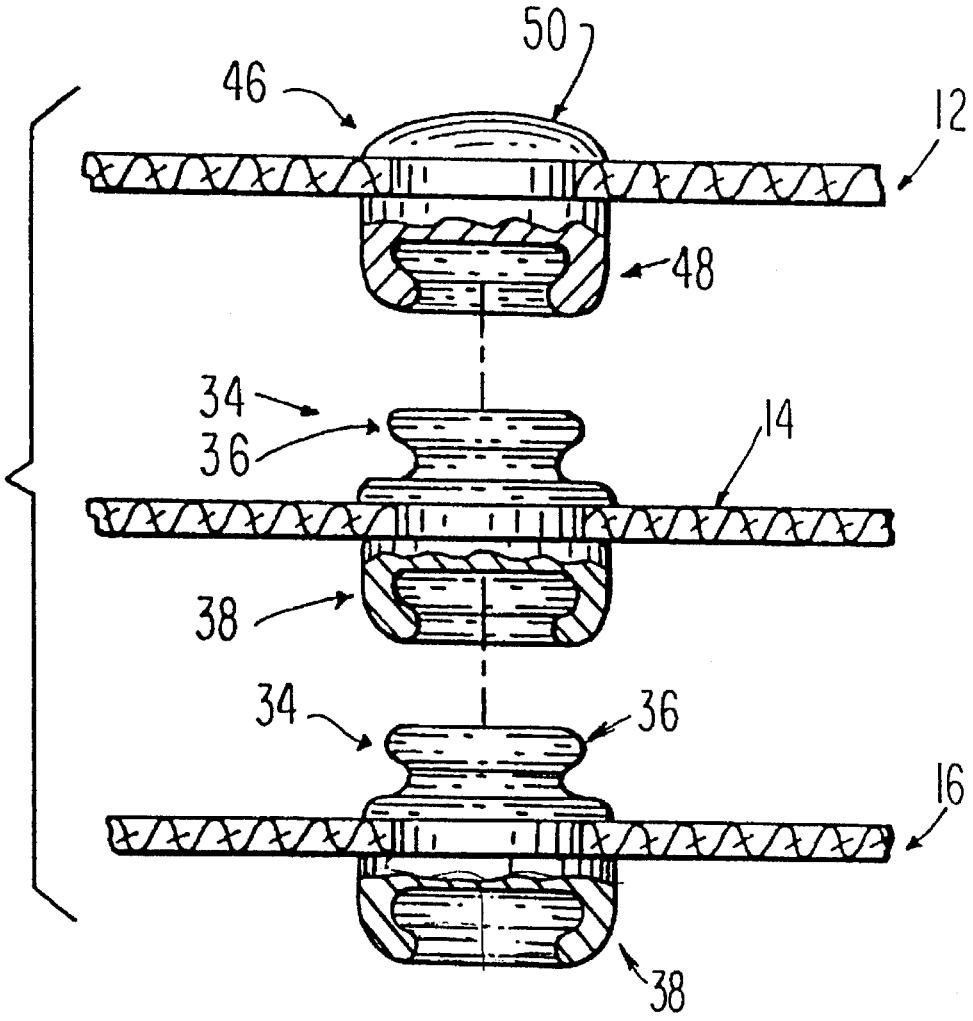
FIG. 3A is a side view of the preferred arrangement of two-sided snap fasteners on the inner and outer bags.

FIG. 3A illustrates the preferred arrangement of two-sided snap fasteners 34 on the inner bag 16 and outer bag 14. The two-sided snap fasteners 34 may be disposed proximate the adjacent edges of an open side of each bag 14, 16 as depicted in FIG. 1. In the event the slide-type fasteners 22 (shown in FIG. 1) on one or both bags 14, 16 fail to operate, the arrangement shown in FIG. 3A facilitates closing of one or both bags 14, 16 by overlapping adjacent edges of the open side and engaging their corresponding two-sided snap fasteners 34.

Figure 4:
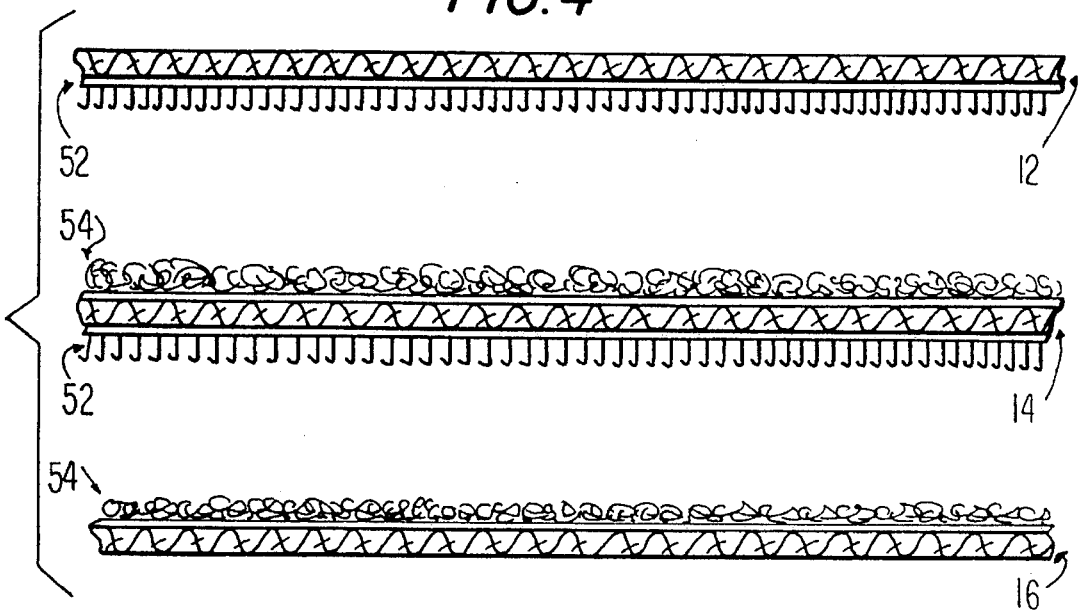
FIG. 4 is a side view of hook-and-loop fasteners, (e.g. Velcro®) another embodiment of non-slide-type fastener, shown in an unconnected relationship with each other.

FIG. 4 illustrates another embodiment of the non-slide-type fastening means. According to this embodiment, the non-slide-type fastening means can be of continuous or discrete strips of hook-and-loop fastener, commonly known by the trademark Velcro®, secured to the outer and inner walls of a bag and proximate and along both sides of the slide-type fastening means 22. As depicted in FIG. 4, the hook-and-loop fasteners have hook-type surfaces 52 and loop-type surfaces 54 arranged in a stacked manner on the outer shell 12, outer bag 16, and inner bag 14.

Figure 5:
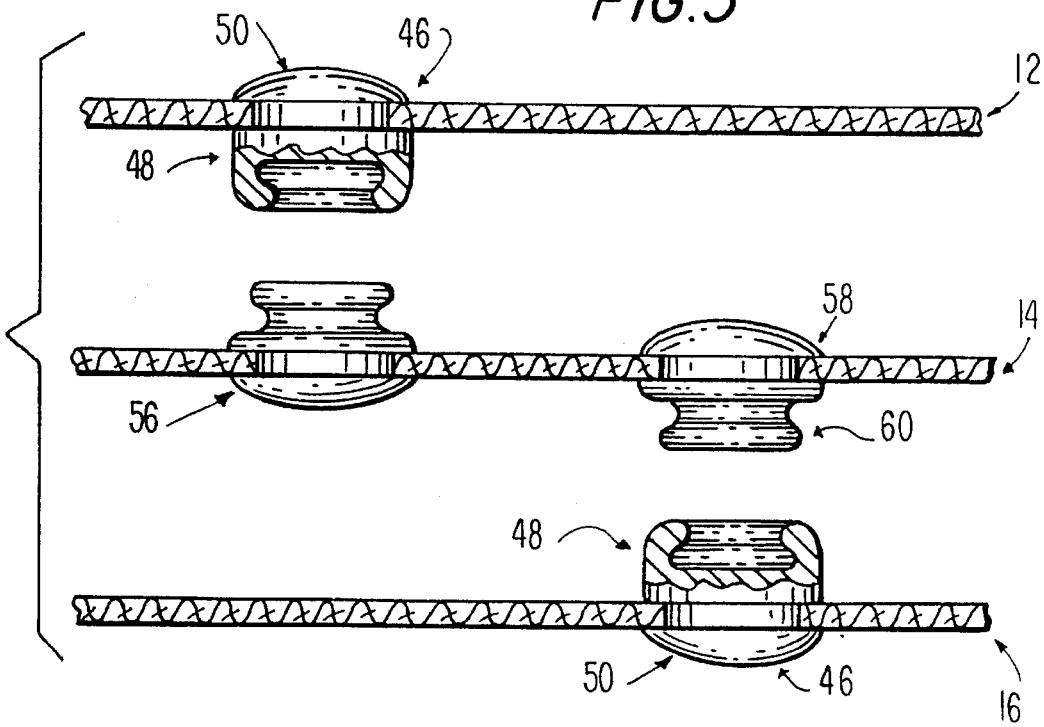
FIG. 5 is a side view of a one-sided snap-type fasteners, yet another embodiment of non-slide-type fastener, shown in an unconnected relationship with each other.

Yet another embodiment of the non-slide-type fastening means may consist of pairs of one-sided male and female snap-type fasteners placed next to each other so that, in combination, they substantially achieve the same purpose as the two-sided snap-type fasteners 34 discussed above. As can be seen in FIG. 5, one-sided female fasteners 46 having a cap portion 50 and a female portion 48 may be employed on both outer shell 12 and inner bag 14. One-sided male fasteners 56 having a cap portion 58 and a male portion 60 can be arranged in pairs such that the male portions of a first and second fastener are oppositely disposed and arranged in a stacked manner with the corresponding one-sided female fasteners on the outer shell 12 and inner bag 14. Of course, the aforementioned scheme may also be effectuated by changing the genders of the one-sided snap-type fasteners correspondingly.

Figure 6:
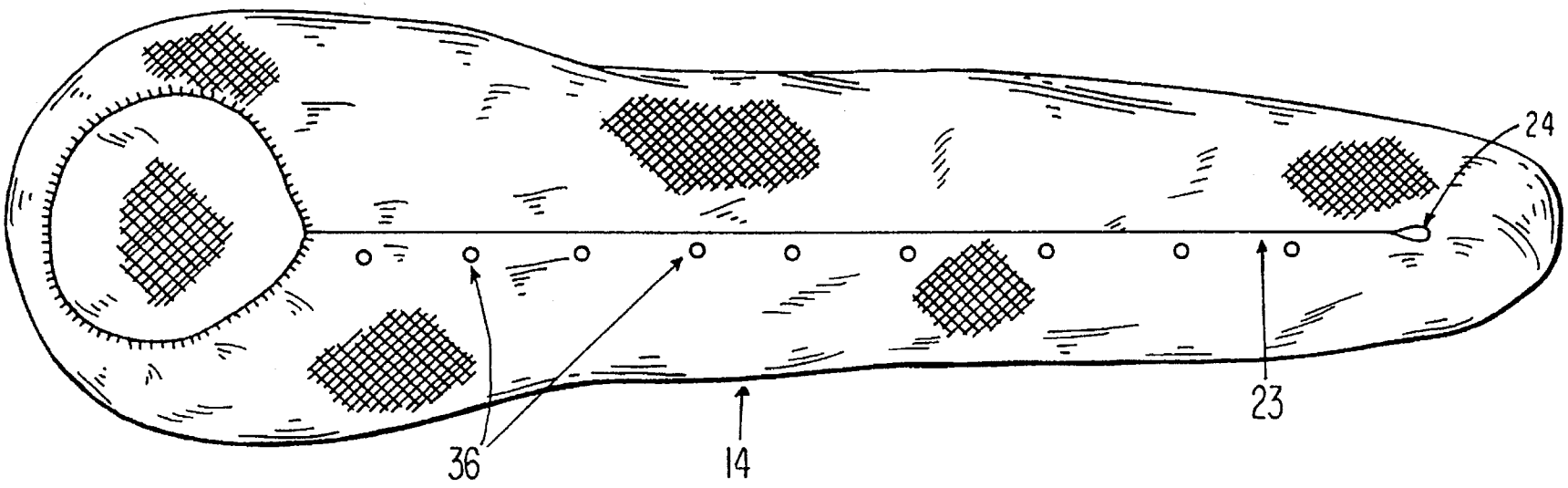
FIG. 6 is a top view of the outer bag employed in FIG. 1 with its open side closed by the engagement of corresponding two-sided snap-type fasteners of FIG. 3.

The stacked arrangement of non-slide-type fastening means being engageable in a stacked manner also enables a user to close an open side by overlapping the adjacent edges 23, 24 thereof and then selectively attaching corresponding non-slide-type fastening means. FIG. 6 illustrates how the two-sided snap-type fasteners 34 on the outer bag 14 of FIG. 1 accomplish this operation. In effect, the non-slide-type fastening means serves as a fail-safe feature for closing an open side of a bag in the event the slide-type fastening means 22 fails to operate.

Having described the various structural parts of the sleeping bag, the operation of the sleeping bag 10 is described as follows.

A user may put together any desired number of layers of bags by sliding at least one inner bag 16 into outer bag 14 and then attaching the bags to each other by stacking and engaging corresponding non-slide-type fastening means. If desired, a weather-resistant outer shell 12 may also be secured to the outer bag 14 in a similar fashion. Depending on the ambient temperature and the desired interior temperature of the sleeping bag 10, a user may leave the slide-type fastening means 22 of the inner bags 16 disengaged so as to result in a minimal decrease in the interior compartment space of the sleeping bag 10. However, if a user were to engage all of the slide-type fastening means 22, the sleeping bag resulted has greater warmth retaining capacity than that of a conventional sleeping bag with equivalent thickness. This is because more heat escapes through the single slide-type fastening means 22 of the conventional sleeping bag than through the series of slide-type fastening means 22 of the sleeping bag 10.

In the event a slide-type fastening means 22 fails to operate, a user may choose to close the open side of the affected bag by overlapping adjacent edges 23, 24 of the failed slide-type fastening means 22 and engaging corresponding non-slide type fastening means. This fail-safe feature will be appreciated especially when the user is subjected to extreme cold environment.

Although not shown in the drawings, it will, however, be readily ascertained by those skilled in the art that more than one inner bag may be made attachable to and within the outer bag 14 depending on the desired degree of protection provided by the sleeping bag 10.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

The invention is not limited by the embodiments described above which are presented as examples only but can be modified in various ways within the scope of protection defined by the appended patent claims.

What is claimed is:

1. A sleeping bag device for outdoor use comprising:

an inner bag and an outer bag, each bag having an outer surface, an inner surface, an open side defined by two adjacent edges, and a head opening, said inner surface defining an interior space for receiving a human body therein, said outer surface and said inner surface of each bag defining a volume therebetween, thermal insulating material disposed in and substantially filling said volume, and said outer bag being dimensioned for receiving therewithin said inner bag;

each bag including a first fastening means disposed proximate the two adjacent edges of the open side of each bag for closure of the open side;

each bag further including a second fastening means having a top and a bottom engagement surface disposed on said outer and inner surfaces proximate said two adjacent edges, the top and bottom engagement surfaces of corresponding second fastening means of each bag being selectively attachable to each other when said inner bag is positioned within the interior space of said outer bag.

2. A sleeping bag device as recited in claim 1, wherein said first fastening means includes a zipper.

3. A sleeping bag device as recited in claim 1, wherein said second fastening means in each bag is disposed along both adjacent edges of the open side.

4. A sleeping bag device as recited in claim 3, wherein said second fastening means is disposed along and substantially proximate said first fastening means so that if said first fastening means fails to close the open side, then the open side may be closed by overlapping the adjacent edges of the open side and engaging top and bottom engagement surfaces of corresponding second fastening means disposed on both adjacent edges of the open side.

5. A sleeping bag device as recited in claim 4, wherein said second fastening means includes male and female snap fastener portions for defining said top and bottom engagement surfaces.

6. A sleeping bag device as recited in claim 4, wherein said second fastening means includes hook-and-loop fasteners for defining said top and bottom engagement surfaces.

7. A sleeping bag device as recited in claim 1, further comprising a water-resistant outer shell, said outer shell having a third fastening means, said third fastening means having engagement surfaces disposed on an inner surface of said outer shell for selective attachment to said top engagement surface of said second fastening means of said outer bag.

* * * * *